United States Patent [19]

Tuckwood

[11] Patent Number: 4,854,883

[45] Date of Patent: Aug. 8, 1989

[54] ELECTRICAL CONNECTOR FOR A PRINTED CIRCUIT

[75] Inventor: Denis W. Tuckwood, Beeston, United Kingdom

[73] Assignee: Pressac Limited, Long Eaton, United Kingdom

[21] Appl. No.: 142,566

[22] Filed: Jan. 11, 1988

[30] Foreign Application Priority Data

Feb. 13, 1987 [GB] United Kingdom ..... 8703389

[51] Int. Cl.[4] ..... H01R 9/09; H01R 4/24; H01R 9/07

[52] U.S. Cl. ..... 439/84; 439/422; 439/492

[58] Field of Search ..... 439/77, 84, 422, 492

[56] References Cited

U.S. PATENT DOCUMENTS 3,691,509 9/1972 Krol ..... 439/422
4,639,057 1/1987 Daum ..... 439/77

*Primary Examiner*—Steven C. Bishop
*Attorney, Agent, or Firm*—Richard R. Mybeck

[57] ABSTRACT

An electrical connector (10) comprises a housing (12) housing electrical contacts (14). The housing (12) has securing means (16) which help secure the connector (12) to a printed circuit (18) (which may be flexible) comprising contacts (22) each including a back portion (24) having two sets of deformable spaced parallel legs (26). In an open position a contact (22) can be received between the legs (26) which can be crimped to a closed position to clamp then in contact with the contact (22).

7 Claims, 2 Drawing Sheets

ELECTRICAL CONNECTOR FOR A PRINTED CIRCUIT

FIELD OF THE INVENTION

This invention relates to an electrical connector for a printed circuit.

The expression "printed circuit" as used herein refers to any assembly comprising an electrical circuit disposed on or in a substrate.

Flexible circuits comprise an electrical circuit disposed on or in a flexible substrate. Typically the electrical circuit is formed of copper, and the substrate is a plastics film such as a MYLAR film. Flexible circuits have a variety of applications, including the wiring of fascias in vehicles.

SUMMARY OF THE INVENTION

According to the present invention there is provided an electrical connector for a printed circuit comprising at least one contact adapted to be integrally connected with a respective contact on the printed circuit.

Advantageously the or each connector contact includes a back portion having two legs depending therefrom adapted to receive a respective circuit contact therebetween wherein the legs are deformable between an open position and a closed position: in the open position the respective circuit contact can be received between the legs, and in the closed position the respective circuit contact can be clamped between the back portion and the legs. In a preferred embodiment two or more sets of legs are provided.

Desirably the back portion and the legs have a substantially U-shaped configuration when the legs are in the open position.

It is preferred that the legs are crimped in the closed position, so that the respective circuit contact is held securely in position.

The connector may be provided with a housing which houses the or each connector contact.

It is desirable that the legs of the or each connector contact are capable of puncturing the substrate of the printed circuit or pass through corresponding holes already provided in the printed circuit.

The connector may be adapted to connect any desired component to the printed circuit. If desired the connector may form part of a switch.

BRIEF DESCRIPTION OF THE DRAWINGS

Reference is now made to the accompanying drawings, in which.

DESCRIPTION OF THE PREFERRED EMBODIMENT

Figure 1:
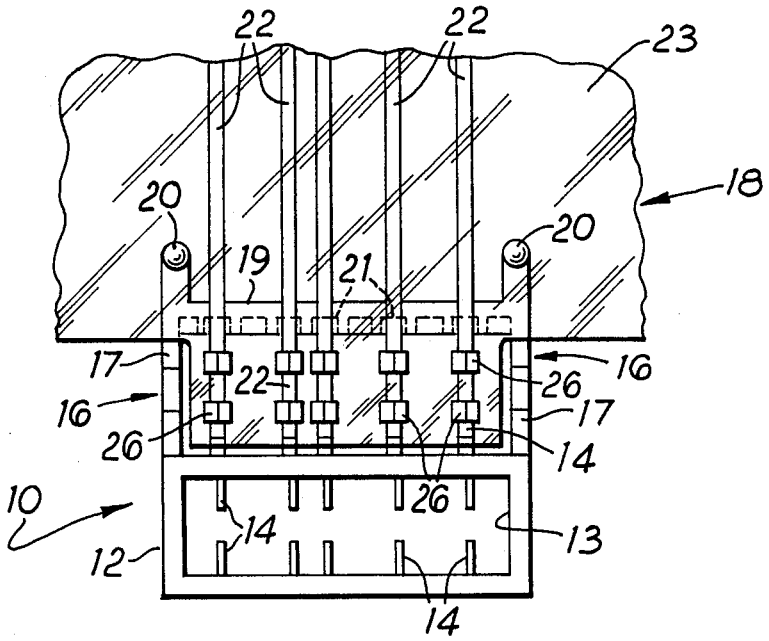
FIG. 1 is a schematic plan view from above of an electrical connector according to the invention shown connected to a printed circuit.

In the drawings a connector generally designated 10 comprises a housing 12 moulded of a suitable insulating plastics material and which houses a plurality of electrical contacts 14.

The housing 12 comprises securing means 16 serving to help secure the connector 10 to a printed circuit 18. The securing means 16 of the preferred embodiment comprises a frame portion projecting from a body portion provided by a socket 13 of the housing 12. The frame portion comprises two arms 17 projecting from the socket 13 from end portions of which project at right angles and includes two projections 20 which extend through the printed circuit 18.

The printed circuit 18 may be a flexible circuit. The printed circuit 18 shown in the drawings comprises a plurality of circuit contacts 22 (which form part of an electrical circuit) disposed within a MYLAR substrate 23. The substrate 23 is suitably provided with holes, through which the projections 20 extend, which locate the housing 12, and thus the contacts carried by it, so that the contacts 14 are in register with the corresponding circuit contacts 22.

Figure 2:
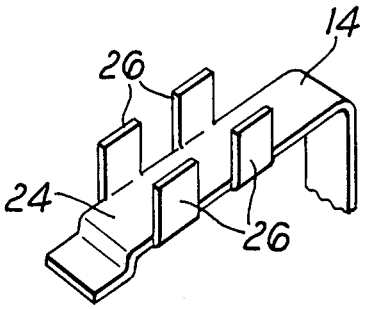
FIG. 2 is a perspective view of a part of an electrical contact for an electrical connector according to the invention.
Figure 3:
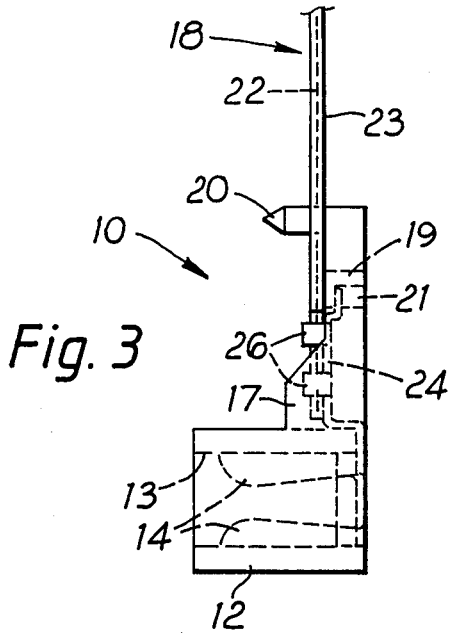
FIG. 3 is a schematic view of the connector shown in FIG. 1.
Figure 4:
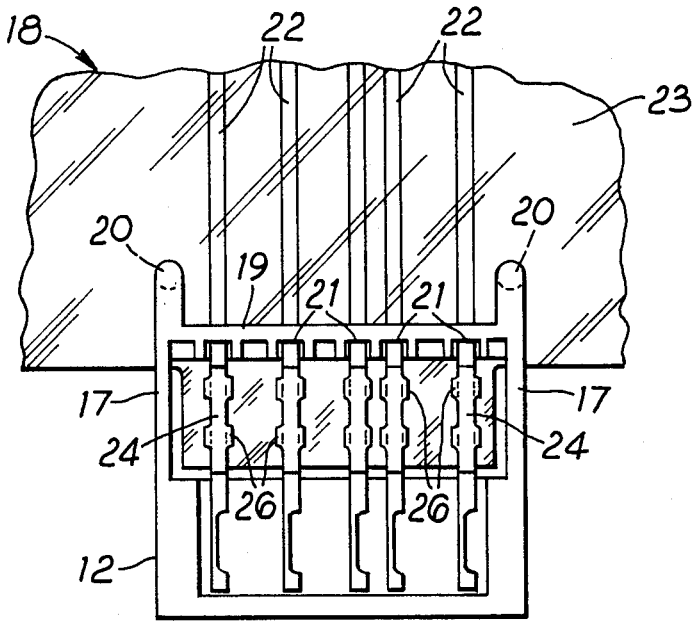
FIG. 4 is a view from beneath the connector shown in FIG. 1.

Each contact 14 comprises a first portion which includes a back portion 24 having two sets of spaced parallel legs 26 extending therefrom, and which projects from the socket 13 of the housing 12. In the connector shown in the drawings the first portions are parallel and generally coplanar being supported by the frame portion of the securing means 16. The arms 17 of the frame portion are connected by a transverse member 19 adapted to support and locate end portions of the contacts 14 remove from the socket 13 and to support the printed circuit 18. The member 19 is provided with a plurality of recesses 21 each of which receives an end portion of a contact 14 which abuts an under surface of a lip of the transverse member 19 at the end of the recess 21: the printed circuit 18 engages an upper surface of the transverse member 19 when in position. The legs 26 of the contacts 14 are deformable and are movable between an open position (FIG. 2) and a closed position (Figure 1). In the open position a respective one of the circuit contacts 22 can be received in the space between the legs 24; in the closed position the legs 26 clamp the respective circuit contact 22 between themselves and the back portion 24. The legs 26 can be crimped to keep them clamped against and in electrical contact with the respective circuit contact 22.

The legs 26 are capable of piercing the MYLAR substrate 23, so that they can make electrical contact with the respective circuit contact 22.

The contacts 4 of the connector shown in the drawings further comprise second portions accommodated within the socket 13 of the housing 12 and adapted to engage contacts of a cooperating male plug portion to which connection is to be made which may be inserted into the socket. The second portions are bowed inwardly of the socket and thus resiliently biased towards an inserted plug portion to make good electrical contact.

In use, the connector 10 is located by the projections 20 relative to a printed circuit 18 with the frame portion of the securing means 16 beneath the substrate 23. The legs 26 project, from beneath the circuit 18, through the substrate 23 and are clinched into engagement with the respective circuits 22. The remote ends of the contacts 14 are thus at an opposite sides of the frame portion of the securing means 16 to the substrate and the clinching of the legs 26 assist in clamping the substrate 23 and remote ends of the contacts 14 firmly against the frame portion to provide support for both contacts 14 and substrate 23 and to mount the housing 12 on the substrate 23.

I claim:

1. An electrical connector for a printed circuit comprising a housing having a body portion providing a socket opening in a first direction, and two parallel arms projecting from said body portion in a second direction disposed at right angles to said first direction, said connector also having a plurality of electrical contacts carried by the housing, each said contact having a first portion disposed between said arms and including a back portion projecting from said body portion in the same direction as and generally parallel with said arms and a second portion accommodated within said housing and adapted to engage the contacts of a cooperating male plug portion inserted into the socket to which connection is to be made, each said arm at an end portion remote from said body portion, having a projection projecting at right angles to said arm, each said projection being adapted to be inserted in locator holes in a substrate to locate the housing relative thereto, and the contact carried thereby to register said contacts with corresponding circuit contacts, said first portion of each said contact further having at least one pair of spaced legs projecting, in an open position, from said back portion in the same direction as said projections from said arms, each said pair of legs being adapted to receive a corresponding circuit contact between said legs in the open position when said connector is assembled with a corresponding printed circuit so that said projections are disposed in said locator holes, said legs being deformable from said open position to a closed position to clamp the circuit contact between said back portion and said legs.

2. A connector according to claim 1 wherein the back portion and the legs have a substantially U-shaped configuration when the legs are in the open position.

3. A connector according to claim 1 wherein the connector contacts are capable of puncturing a substrate of the printed circuit.

4. A connector according to claim 1 wherein each contact comprises two or more pairs of legs.

5. A connector according to claim 1 comprising a transverse member connecting the arms remote from the body portion, the transverse member being adapted to support and locate end portions of said first portions of the contacts remote from the body portion and to support a printed circuit.

6. A connector according to claim 5 wherein the transverse member comprises a plurality of recesses each adapted to receive an end portion of a contact.

7. An electrical connector for use with a printed circuit, said connector comprising a housing, having a body portion, two parallel arm portions, said body portion having a socket opening defined therein, said opening extending in a first direction, said arm portions extending from said body portion in a second direction, said second direction being disposed at right angles to said first direction, and a plurality of electrical contacts disposed within said housing, each of said contacts having a first portion, a second portion and a back portion, said first portion being disposed between said arm portions, said second portion being disposed within said housing and adapted to coactively engage a cooperating male plug insertable therewithin, and said back portion extending from said body portion in generally parallel relationship to said parallel arm portions, each arm portion having a distal and a proximal end relative to said body portion and a projection extending in a plane disposed generally normal to said arm portion at said distal end for insertion into locator holes defined in an associated substrate to position said housing and said contact disposed therewithin to register said contacts with corresponding contacts in the printed circuit, each said first portion of each said contact having at least one pair of spaced legs extending, when in an open position, from said back portion in a direction generally parallel to said plane of said projection and adapted to receive a circuit contact therebetween when said connector is assembled with a corresponding printed circuit, said legs being deformable into a closed position to secure said corresponding circuit contact between said back portion and said legs.

* * * * *